United States Patent [19]

Lichter

[11] Patent Number: 4,852,503

[45] Date of Patent: Aug. 1, 1989

[54] SLIDING DOOR SAFE WITH ANTI-INTRUSION LOCK DEVICE

[76] Inventor: Robert J. Lichter, 15571 Placid Cir., Huntington Beach, Calif. 92647

[21] Appl. No.: 160,817

[22] Filed: Feb. 26, 1988

[51] Int. Cl.[4] ..... E05G 1/04; E05D 15/56

[52] U.S. Cl. ..... 109/59 R; 109/67; 109/70

[58] Field of Search ..... 109/59 R, 59 T, 64, 109/67, 69, 70, 73, 74, 75; 49/464, 368, 370

[56] References Cited

U.S. PATENT DOCUMENTS

| | | | |
|---|---|---|---|
| 67,045 | 7/1867 | Hall . | |
| 3,481,288 | 12/1969 | Teleky | 109/58 |
| 3,715,998 | 2/1973 | Teleky | 109/58 |
| 3,842,761 | 10/1974 | Bloom | 109/64 |
| 4,070,074 | 1/1978 | Rohme | 312/245 |
| 4,136,792 | 1/1979 | Wilson | 214/145 A |
| 4,145,978 | 3/1979 | Johnson et al. | 109/64 |
| 4,176,440 | 12/1979 | Lichter | 29/458 |
| 4,294,040 | 10/1981 | Crotti | 49/254 |
| 4,712,490 | 12/1987 | Lichter | 109/73 |

*Primary Examiner*—Neill R. Wilson

*Attorney, Agent, or Firm*—Gausewitz, Carr & Rothenberg

[57] ABSTRACT

A sliding door safe with an anti-intrusion locking mechanism, wherein a one or two door arrangement slides in a given direction on rails or ledges between first and second grooves of unequal depths in opposing walls of the valuables receiving chamber. The locking mechanism is carried by the door adjacent the deeper groove and includes a key actuable barrel with a lock arm carrying a blocking member, which, upon locking, is interposed between a position of one door and the adjacent portion of the wall of the chamber to preclude forcible sliding of the door or doors in the given direction. The locking assembly also includes a plate member of a bracket secured in spaced relation to the inner surface of the door in alignment with the lock arm and in proximate relation thereto to deter displacement of the lock arm under force of a punch applied to the lock. The bracket and the blocking member are deterrents to forcible entry and removal of the door.

24 Claims, 5 Drawing Sheets

FIG. 1.
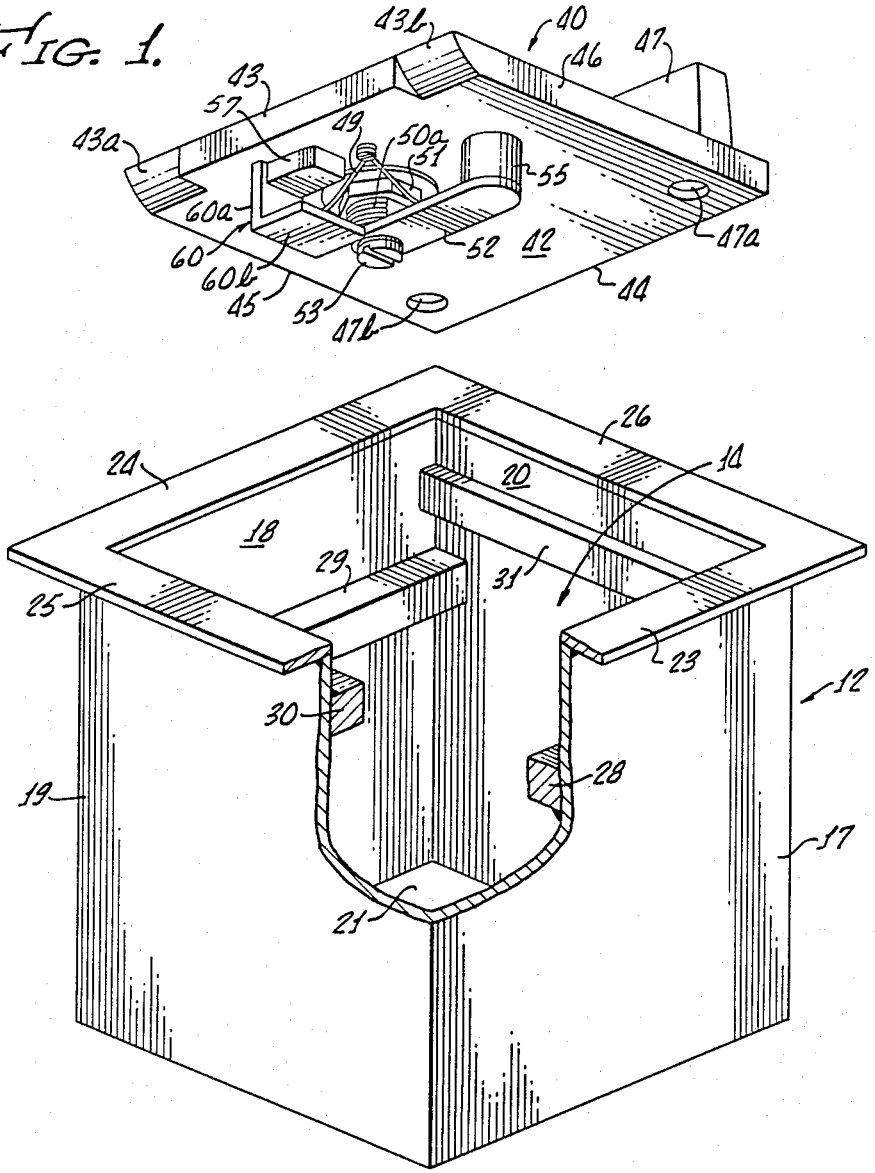
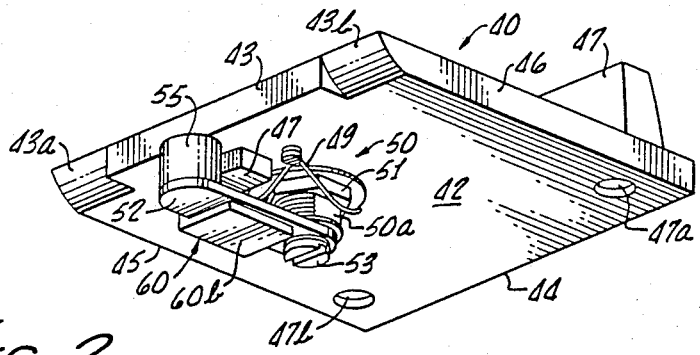
FIG. 2.

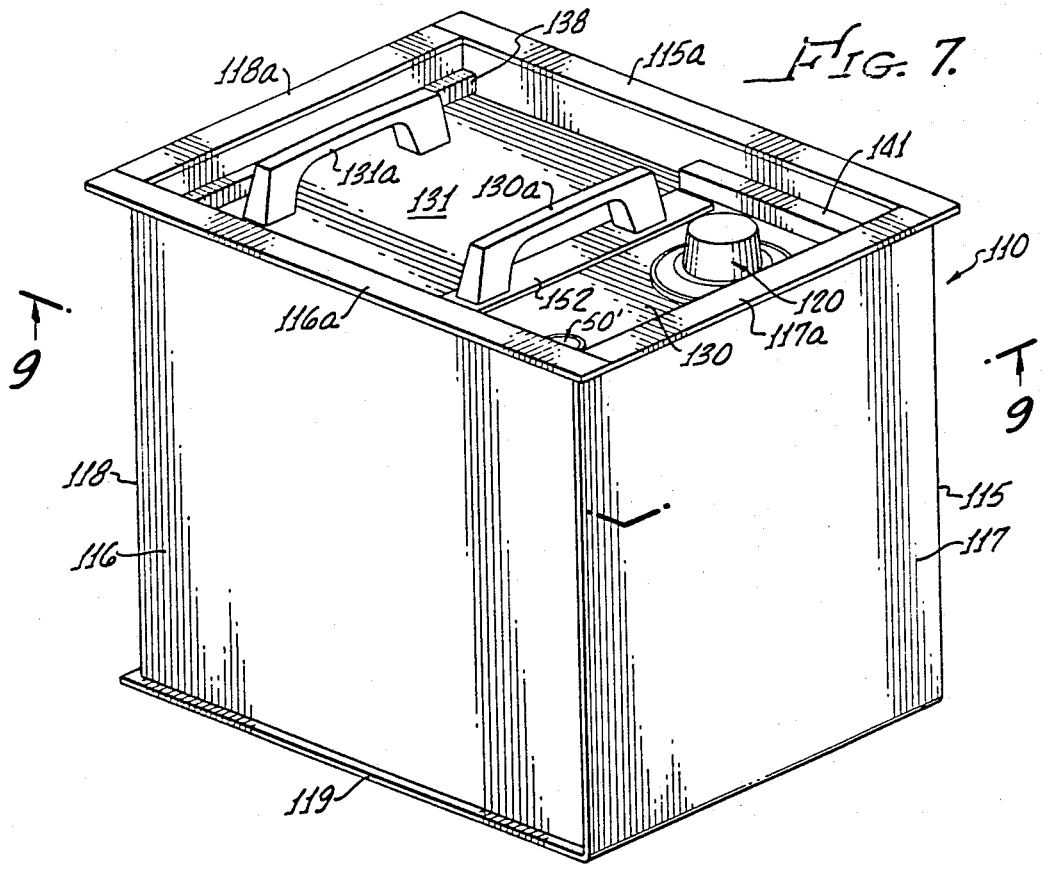
FIG. 7.
FIG. 8.
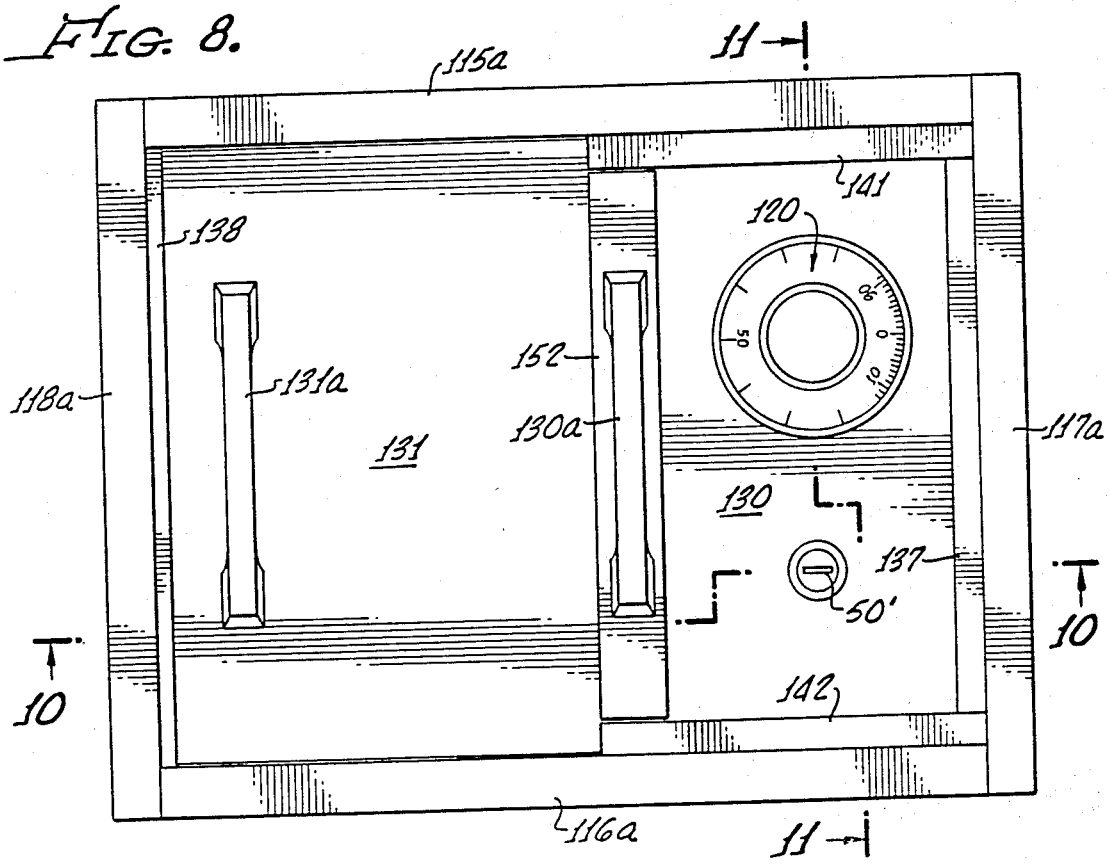

SLIDING DOOR SAFE WITH ANTI-INTRUSION LOCK DEVICE

CROSS-REFERENCE TO RELATED APPLICATION

The subject matter of this application is related to the subject matter of applicant's copending patent application filed concurrently herewith, bearing patent application Ser. No. 07/160,868 and filing date of Feb. 26, 1988 entitled "Safe With Double Sliding Door".

BACKGROUND OF THE INVENTION

The background of the invention will be discussed in two parts:

1. Field of the Invention

This invention relates to the field of safes adapted to contain valuable papers and articles, and more particularly to a safe having a sliding door with an anti-intrusion lock device.

2. Description of the Prior Art

There are numerous prior art wall and floor safes adapted to be embedded in concrete, etc. or adapted to be free-standing. The variations, and complexities in such safe structures have a direct impact on the cost of construction, and ultimately, the cost of such safes. Many of such safes are intended for residential use, and may be installed in a wall or in a floor of the residence, and, in the latter instance such safes are normally embedded in concrete.

A sliding door safe is shown and described in U.S. Pat. No. 4,712,490, issued to the inventor hereof on Dec. 17, 1987, such patent being entitled, "Safe", which discloses a sliding safe door structure with a lock mechanism in which the lock bolt is placed in shear.

An early safe structure is shown and described in U.S. Pat. No. 67,045 issued July 23, 1867, to Hall for a "Burglar-Proof Safe" in which a stepped laminated door structure fits within a correspondingly formed door opening.

Another safe structure is shown and described in U.S. Pat. No. 3,481,288, entitled "Wall Safe", issued to Teleky on Dec. 2, 1969, the safe including a permanently installed container with lateral vertically arranged recesses configured for receiving a separate door portion by lateral insertion into the recesses.

U.S. Pat. No. 3,715,998, is directed to another such safe structure, and is entitled "Wall Safe", such patent being issued to Teleky on Feb. 13, 1973, the structure having a door which is substantially rectangular and when it is in the closed position the margins of the door substantially throughout their entire length are overlapped by recesses along the margins of the opening that is closed by the door.

U.S. Pat. No. 4,070,074, entitled "Tamper-Proof Cabinet", issued to Rohme, on Jan. 24, 1978, such patent disclosing a cabinet having a door which is required to be unlatched by an initial unlatching sliding movement and then the usual pivotal traverse from its closed into its open position.

Another safe structure is shown and described in U.S. Pat. No. 4,176,440, issued to Robert J. Lichter, the applicant herein, on Dec. 4, 1979, such patent being entitled "Safe, and Method and Apparatus for Building It", the safe being a "do it yourself" safe, wherein the parts are assembled in an appropriate location within the residence, and then the concrete is poured, and the balance of the parts attached.

A building door is shown in U.S. Pat. No. 4,294,040, entitled "Safety Door for Buildings and Rooms", issued Jan. 8, 1957, to Crotti, the patent disclosing a safety door structure which is transversely sliding with one part thereof serving as a supporting column equipped with hinges and the other serving as a door panel rotatably supported by the hinges. the supporting column disappearing from view during the opening stage with the opposite side of the door, including the lock, disappearing from view upon closing with the lock accessible through an access opening.

U.S. Pat No. 4,136,792, was issued to Wilson, on Jan. 30, 1979, and is entitled "Quick Attachment Device for a Lifting Tractor", this patent being included to illustrate closure release mechanisms, and discloses an implement, such as a bucket, for attachment to and removal from, a highlift or tractor.

While the majority of such safe structures include doors with combination lock mechanisms, in some instances, such as in mobile homes, recreational vehicles and the like, a lighter safe is desired. To provide a lighter safe, a key lock mechanism is employed. However, key lock mechanisms are subject to forcible entry by use of a hammer and punch.

In accordance with an aspect of the invention, it is an object to provide a new and improved safe and door structure with a key lock mechanism with anti-intrusion structure.

SUMMARY OF THE INVENTION

The foregoing and other objects are accomplished by providing a safe having a valuables receiving chamber with a generally rectangular opening with a first set of inwardly extending ledges on opposing walls for placement of a plate-shaped separate steel door thereon, and a set of grooves formed on the opposite walls transverse to the first set of opposing walls providing stops for retaining the door arrangement therein, the width of grooves being a distance slightly more than the thickness of the door, or doors, with one groove having a depth substantially greater than the other. With a single door, one edge of the door is inserted on a slight angle into the deeper groove while the other edge is pivoted toward the ledge, the door then being laterally displaced until the latter edge is in abutment with the seat of the shallower groove. A gap is formed at the other end of the door. With two doors, a first door is inserted into a slide rail arrangement formed by a spaced upper ledge and then inserted into the deeper groove, with a second door being inserted into a space between the lower and upper ledges and pivoted toward the lower ledge, after which the two doors are slid in the opposite direction with a gap between the first door edge and the bottom of the deeper groove.

A key lock assembly, referred to as a cam lock assembly, includes a pivotable arm on the reverse side of the door adjacent the deeper groove. The arm includes a blocking member at the end thereof which abuttingly engages the safe wall adjacent the gap when in the locked position. The undersurface of the door is provided with a depending high strength steel projection in proximate relation to the position of the blocking member at a position opposite the wall, with the blocking member intermediate the wall and the projection to provide a deterrent to attempts at forced lateral displacement of the door. An L-shaped metal bracket is secured to the undersurface of the door with a leg thereof parallel to the undersurface and in proximate relation to the arm of the lock assembly in the locked position, with the arm intermediate the door and the leg. Attempts at punching out the lock are resisted by the leg of the bracket. The bracket and the blocking member are deterrents to forcible entry and removal of the door.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 1 is an exploded perspective view of the components of the safe apparatus in accordance with the present invention;

FIG. 2 is a bottom perspective view of the door used in the safe apparatus of FIG. 1 with the lock mechanism thereof shown in the locked position;

FIG. 7 is a perspective view of an alternate embodiment showing a double sliding door safe apparatus utilizing the lock mechanism in accordance with the present invention;

FIG. 8 is a top plan view of the double sliding door safe apparatus of FIG. 7;

DESCRIPTION OF THE PREFERRED EMBODIMENT

Figure 3:
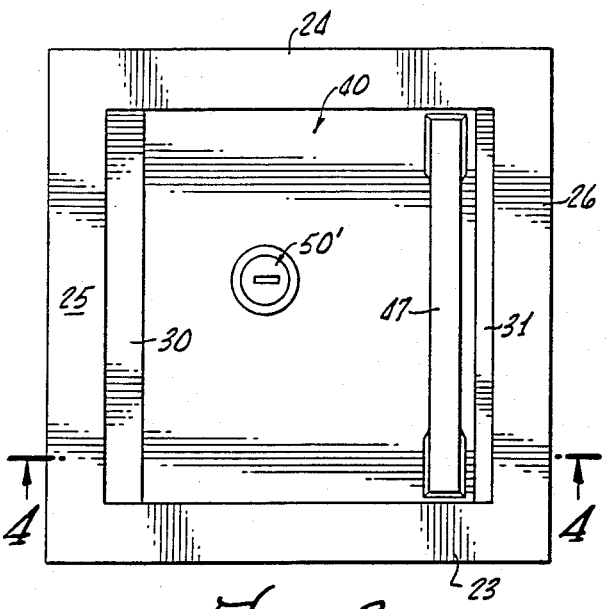
FIG. 3 is a top plan view of the apparatus of FIG. 1, shown in its assembled position with the door in place and locked.
Figure 5:
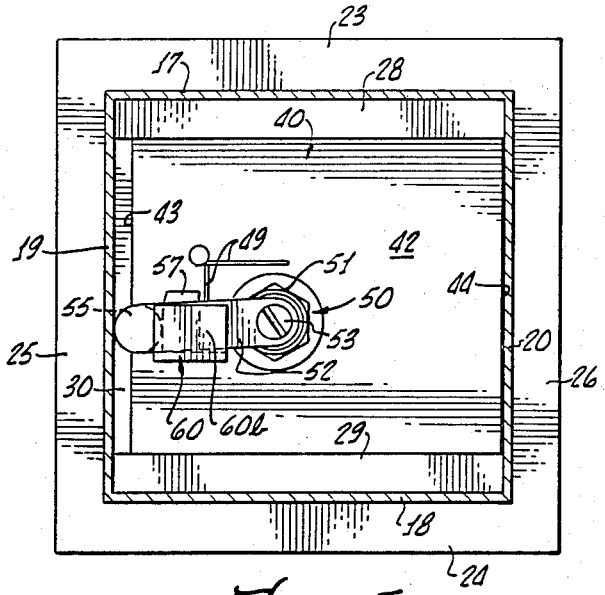
FIG. 5 is a bottom elevational view of a portion of the structure of FIG. 3, partially in cross-section, as viewed generally along line 5—5 of FIG. 4, showing the lock mechanism in its locked position.

Applicant's aforementioned U.S. Pat. No. 4,712,490, is directed to a safe having a plate-shaped separate steel door, and a set of grooves formed on opposing safe walls for retaining the door therein, the width of the grooves being a distance slightly more than the thickness of the door, with one groove being substantially greater than the depth of the other. One edge of the door is inserted on a slight angle into the deeper groove while the other edge is pivoted toward the ledge, the door then being laterally displaced until the latter edge is in abutment with the seat of the shallower groove. A lock assembly on the reverse side of the door has the latch bolt engaging a detent in a metal bar for prevention of lateral movement with reinforcing bolts adjacent the lock bolt preventing force on the lock mechanism in the event of forceful intrusion attempts. The lock assembly is preferably a combination lock assembly.

In the construction of safes, the valuable receiving chamber is ordinarily fabricated by the welding of steel plates. Two items add up to a considerable fraction of the overall cost of the safe, these items being hinge mechanisms and combination lock assemblies. The sliding door safe of the aforementioned patent does not require hinges, thus eliminating one major cost element. Furthermore, with the sliding door, a steel plate of nominal thickness, coupled with the method of attachment, suffices to provide the necessary security, with substantial weight.

However, in many installations, where only a small safe is needed, a combination lock assembly becomes a major factor in the cost of the safe, thereby resulting in an expensive small safe. Furthermore, a small safe with a hinged door and a combination lock is both prohibitively expensive and extremely heavy, thereby precluding its use in those installations where dimensions and weight and are factors. With hinged doors, for a given depth of safe, the depth of the hinged door construction cuts into the depth of the valuables receiving chamber. The sliding door arrangement recovers some of this depth, thereby providing more storage for a given overall size of safe.

In accordance with a first embodiment of the present invention, there is provided a safe construction which provides security, at low cost, with optimum size of the valuables receiving chamber relative to the overall size of the safe. In particular, the safe construction of the present invention may be readily utilized in mobile homes, recreational vehicle, motel rooms and the like, due to the low cost, and relatively low weight.

Referring now to the drawings, and particularly to FIG. 1, there is shown in exploded perspective view a safe, generally designated 10, having a somewhat elongate generally cubical compartment 12, with an opening 13, part of the compartment 12 of which defines a valuable chamber 14. The compartment 12 is formed of a first set of opposing side walls 17 and 18, and an interconnecting set of mutually perpendicular opposing end walls 19 and 20, with an interconnecting bottom 21 opposite the opening 13. Such a compartment 12 may be made, for example, by fabrication from sheet metal or sheet steel of sufficient thickness suitably connected such as by welding. It is also to be understood that the invention described herein is equally applicable to a safe which is formed of all metal, such as by steel casting methods, and as such the invention is not intended to be limited.

The upper edges of the walls 17–20 define a common plane, which includes a peripheral flange defined by generally bar-shaped flange sections 23–26, mitered and welded together and to the upper ends of wall sections 17 through 20, respectively, with the opening defined thereby being the safe access opening 13. The flange may readily be used for attachment of the safe 10 to a surface, such as a wall, or a floor. Spaced downwardly from this common plane, and extending inwardly from the side walls 17 and 18 are integrally attached laterally extending rails 28 and 29, both of which are at a predetermined distance from, and parallel to, the upper flange sections 23 and 24, respectively, of the opening 13 of the compartment 12.

Similarly, the ends walls 19 and 20 have integrally attached opposing laterally extending upper bar members 30 and 31, each being at the same distance from, and generally parallel to, the flange sections 25 and 26, respectively, but spaced closer thereto than the rails 28 and 29. The distance between the lower edges of the upper bar members 30 and 31 and the upper edges of the rails 28 and 29 form door receiving grooves or access ways of a width slightly greater than the thickness of the coacting edges of the door assembly, generally designated 40.

The lower rails 28, 29, may be formed of the same high strength steel bar stock, and suitably secured to the inside surface of the respective walls 17, 18, at the proper location, such as by welding, preferably along a lower edge opposite the door engaging edge. The orientation of the upper bar members 30, 31, is perpendicular to the orientation of the rail members 28, 29.

Figure 6:
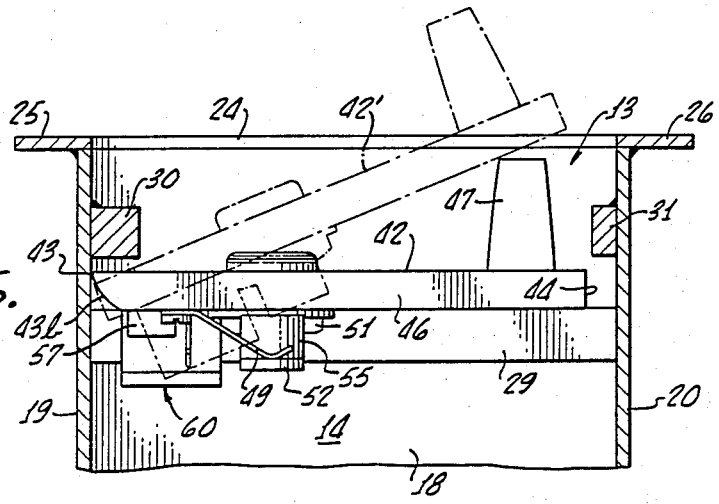
FIG. 6 is a side elevational view of the apparatus similar to FIG. 4, showing the locking mechanism in its unlocked position, and showing the door being inserted or removed.
Figure 4:
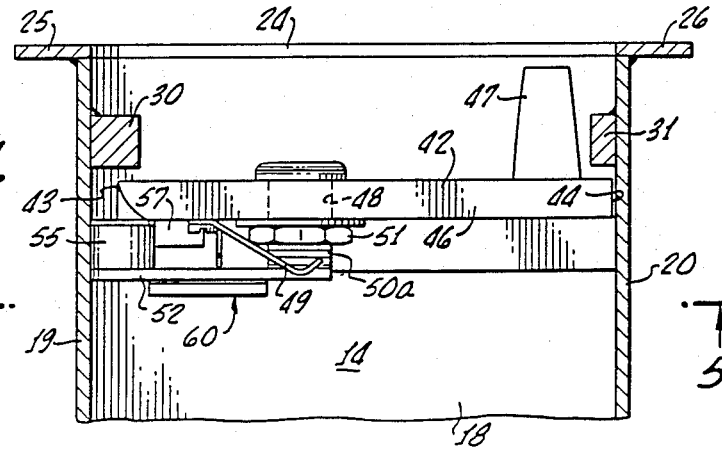
FIG. 4 is a side elevational view of a portion of the structure of FIG. 3, partially in cross-section, as viewed generally along line 4—4 thereof, showing the lock mechanism in its locked position.

As can be seen in FIGS. 1, 4 and 6, the upper bar members 30, 31 are of similar thickness, but the width of the two bar members is different, that is bar member 30 intrudes into the compartment interior a distance from the wall 19 more than twice the distance of intrusion of the bar member 31.

It is to be understood that the directional terms hereinabove and hereafter employed, such as up, down, top, bottom, upper, lower, and words of similar import, are with reference to the orientation of the structure in the drawings, and are not to be construed as limiting, inasmuch as the safe apparatus 10 may be used as a floor safe, or as a wall safe.

The door assembly 40 is formed of a generally rectangular steel plate member 42 having edges 43–46, with the underside of one edge 43 thereof rounded at the corners **43*a* and 43*b* for reasons which will be hereafter discussed. The outer surface of plate member 42 has a lift out generally U-shaped handle member 47 secured thereto, such as with recessed screws 47*a* positioned through countersunk holes in the door plate 42, or by welding. The handle 47 is secured with fasteners in such a way that excessive force, such as by applying a lever to force the door assembly 40** will result in breakage of the fasteners.

Located centrally on the plate member 42 relative to opposing edges 45, 46, and extending through the plate member 42 is an opening 48 (see FIG. 4) through which is inserted the barrel of a key actuated lockset assembly, generally designated 50, which includes a key opening 50' (see FIG. 3), accessible from the exterior of the door assembly 40. The opening 48, and thus the lock assembly 50, is positioned slightly closer to the edge 43 which, as will be hereafter described, in the edge of the door assembly 40 which engages first groove means formed between the wider bar member 30 and the lower rails 28, 29. Second groove means with which the door plate 42 interacts are formed on the opposite side wall 20, which groove means are formed between bar member 31 and the lower rails 28,29.

The lockset assembly 50 is an economical readily available lockset, known as a cam lock, which has been modified, as will be described. The lockset assembly 50 includes a threaded barrel portion **50*a*, which is passed through the opening 48 of the door plate 42 of the door assembly 40, with the barrel 50*a* being secured to the bottom or interior of plate member 42, such as by a nut 51 suitably threadably engaging the barrel portion 50*a*. A locking arm 52 is pivotally secured, such as by a screw 53, to the tumbler actuated piston within the barrel portion 50*a*, and is actuable between locked and unlocked positions with a spring member 49 configured and positioned for frictionally maintaining the locking arm 52 in one of the two positions. Secured to the end of locking arm 52, such as by welding, is a cylindrical bar segment, which serves as an anti-intrusion device, or blocking member 55**.

FIG. 1 depicts the door assembly 40 with the lock assembly 50 in its unlocked position, and FIG. 2 depicts the same view with the lock assembly 50 in its locked position, about ninety degrees from the unlocked position. The locking arm 52 pivots in a plane generally parallel to the plane of the undersurface of the door plate 42, with a fixed spacing therebetween. The height of the blocking member 55 is slightly less than this spacing (See also FIG. 4). As will become apparent, the locking arm 52 does not, in fact, serve a true locking function in the instant invention. Its primary function is to serve as a carrier for the blocking member 55, and to place the blocking member in the proper position to resist lateral prying of the door assembly 40. By reference to FIG. 4, the diameter or width of the blocking member 55 is such that, when positioned on the arm 52, and with the arm 52 in the locked position, the blocking member extends beyond the edge 43 of the door plate 42 a distance generally equal to the gap formed to the left of the edge 43 with the door plate 42 bottomed against the opposing side wall 20.

By reference to FIGS. 2 and 4, a short bar piece stop member 57 formed of steel is suitably secured to the undersurface of the door plate 42 at a position in alignment with the locking arm 52 in its locked position, the stop member 57 being located rearwardly of the position of the blocking member 55. The stop member 57 is positioned for coaction with a side of the blocking member 55, to assist in the deterrent effect in resisting lateral prying of the door plate 42 of the door plate assembly.

To further thwart forced entry to the safe apparatus 10, an anti-intrusion member 60, in the form of a short section of angle iron or steel has an edge of a plate-shaped leg **60*a* thereof welded to the undersurface of the door plate member 42, with the other leg 60*b* thereof, extending in a plane parallel to, and slightly below, the plane of pivoting of the locking arm 52. As best illustrated in FIGS. 2 and 4, the locking arm 52 is a metal strip or bar, with the plane of the bar lying in, and part of, the above referred to plane of pivoting of the locking arm 52. This plane is on close proximate relation to the plane of leg 60*b* of member 60, with an edge of the arm 52 in proximate relation to the other leg 60*a*. The interrelationship of the anti-intrusion member 60, the blocking member 55 and the stop member 57, as it affects the locking of the door assembly 40** and defeats attempts at prying as will be discussed hereinafter.

Referring now to the drawings, and particularly to FIGS. 1, 4 and 6, the relationship of the rail members 28, 29, and the bar members 30, 31, to the door assembly 40 will be described. The door plate 42 of the door assembly 40 is dimensioned for being received in and completely removed from the upper opening 13 of the compartment 12. For this purpose, the plate member 42 is generally rectangularly configured, or square, in plan elevation with the width thereof closely approximating the width of the compartment 12.

The length of the plate member 42 of the door assembly 40 is dimensioned to provide clearance while inserting at an angle as shown in dotted lines in FIG. 6, with the rounded lower corners 43*a* and 43*b* of edge 43 positioned in the grooves formed beneath the intruding inner edge of bar member 30 and the proximate ends of rail member 28, 29. The length of the plate member 42 is slightly greater than the distance between the facing inner edges of bar members 30 and 31, and less than the dimension between the corresponding walls 19 and 20 to which the bar members 30 and 31 are affixed.

By reference to FIG. 4, which shows the door plate 42 slid to its locked position, the length of the door plate 42 in the direction of sliding is generally equal to the spacing between walls 19 and 20, less a dimension generally equal to about one-half the intrusion of bar member 30, or alternatively stated, less a dimension generally equal to the intrusion of the narrower bar member 31, with a slight variance allowing for tolerances. Correspondingly, with the arm 52 in the locked position, the blocking member 55 extends beyond the edge 43 of the door plate 42 a distance generally equal to the difference between the dimension between opposing surfaces of walls 19 and 20, and the dimension of the door plate 42 in the direction of sliding. In brief, this projecting portion of the blocking member 55 fills the gap between the edge 43 and the adjacent wall 19.

In any event, for enabling closing of the door assembly 40, the dimension of the door plate 42 in the direction of closure must be sufficient for enabling the edge 44 thereof to clear the bar 31 when the door plate 42 is pivoted about its edge 43 from the broken line position 42' to the solid line position shown in FIG. 6, with the locking arm 52 of the lock assembly 50 in the unlocked position shown in FIG. 1.

For closing the safe 10, the door assembly 40 is positioned at the angle shown in dotted lines 42' in FIG. 6 with the edge 43 partially beneath the bar member 30 with the rounded lower corner edges 43*a* and 43*b* of plate member 42 resting on the lengthwise extending rail members 28 and 29. A slight force is exerted laterally until this first edge 43 is abutting against the sidewall 19 during which time the door assembly 40 is being lowered along the opposite edge 44 until this opposite edge 44 clears the upper corner of bar member 31. Thereafter the door assembly 40 is permitted to drop until totally supported by the longitudinally extending ledges formed by rail members 28 and 29. The door assembly 40 is then shifted laterally in the opposite direction (to the right as shown by the arrow in FIG. 4) into the space formed between bar 31 and the proximate portions of rail members 28 and 29, until the opposite edge of plate member 42 is seated in the space in abutting relation with the opposite sidewall 20, as shown in solid lines in FIG. 4, the sidewall 20 being the bottom or the seat of the door receiving groove or space so-formed.

The lock assembly 50 is then actuated and the blocking member 55 assumes the position shown in FIG. 4, that is, with the forward edge thereof in abutting or near abutting relation with the opposite side wall 19. The rearward edge of the blocking member 57 is then in abutting, or near abutting, relation with the stop member 57. Since the direction to open the door assembly 40 is to the left as viewed in FIG. 4, in the event a lever of the like, is used as a pry bar against the handle 47, initially, as previously stated, the handle fasteners or screws will fracture. Should the intruder be successful in inserting the pry bar between the edge 44 and the adjacent side wall 20, any attempt to forcibly slide the door plate 42 to the left will be resisted by the blocking member 55.

Lateral pressure to the left on the door plate 42 will be transferred, in turn, to the stop member 57, which, for all practical purposes, in part of the door plate 42. Since the stop member 57 is in proximate relation to the blocking member 55, this force will urge the blocking member 55 to the left, against the side wall 19. As illustrated, the blocking member 57 is of a vertical dimension (as viewed in FIG. 4), which substantially encompasses the distance between the plane of the locking arm 52 and the plane of the undersurface of the door plate 42. The stop member depends about half or more of this vertical dimension, to thus provide a substantial vertical surface for edge abutment with the blocking member 55. Furthermore, with the relatively inexpensive lock assembly 50, the locking arm 52 is not formed of high strength steel, but may simply be a zinc composition metal, which would bend or fracture under stress. However, with the stop member 57 and blocking member 55 configured, dimensioned and positioned as described, the arm 52 receives little, if any, of the stress of the attempted intrusion. The primary force applied would be the stop member 57 against the blocking member 55 against the side wall 19. Thus, in essence, the locking arm 52 acts more in the nature of a carrier for the blocking member 55.

With such an inexpensive lock assembly, the instant invention provides an additional measure of security against intrusion. If a punch or other such tool is driven downwardly in the direction of the broad arrow 70 positioned above the lock assembly 50 from the exterior of the door assembly 40, the lock will fracture and be pushed toward the interior of the safe 10, and, as discussed, the locking arm 52 will bend or fracture. However, such an action will not, by itself, dislodge the blocking member 55 from its position. This is due to the inclusion of the anti-intrusion member 60, wherein the leg 60*b* is in proximate relation to the plane of the locking arm 52.

As shown in FIGS. 3 and 4, the width of the leg 60*b* is such that, there is a space between the edge thereof nearest the lock barrel portion 50*a*, and the adjacent periphery of the barrel portion 50*a*. Should a thief use a punch, the barrel portion 50*a* would be thrust inwardly, but would not contact the adjacent edge of the leg 60*a*. Therefore, any such punch operation would not apply direct force to the leg 60*a* of the anti-intrusion member 60. Any force thereon would be the incidental force occasioned by the locking arm 52 bending or fracturing when such a punch blow is struck. The blocking member 55 and the stop member 57, in coaction with one another, and with the member 55 disposed in proximate relation to the inner surface of the side wall 19 assures that these force are localized and concentrated on the blocking member 55 and stop member 57 only, and are not transmitted to the locking assembly 50.

An alternate embodiment of a sliding two-door arrangement with the lock mechanism according to the invention is depicted in FIGS. 7 through 14. The safe apparatus of the second embodiment is shown and described in Applicant's aforementioned copending cross-referenced patent applications, and the details thereof are described therein and incorporated herein by this reference.

In brief, the two-door safe, generally designated 110, has a somewhat elongate generally rectangular enclosure forming a valuables receiving chamber 112, accessible through an access opening 114. The door arrangement includes first and second doors 130 and 131, for closing the chamber 112, with one of the doors 130 including a combination lock mechanism 120 and an accessory anti-intrusion key lock mechanism 50. To facilitate removal and insertion, as will be described hereafter, door handles 130*a* and 131*a* are provided on doors 130 and 131.

The enclosure is formed of first and second opposing side walls 115 and 116, an interconnecting set of mutually perpendicular third and fourth opposing end walls 117 and 118, and a bottom 119. The walls 115–118 and bottom 119, in the embodiment to be described are formed of steel plate stock which is bent and suitably welded together.

A peripheral flange is formed, such as by straps 115*a–118a* welded to the upper opening to facilitate assembly of the safe 110 within a floor or wall. Spaced downwardly from this opening, and extending inwardly from the side walls 115 and 116 and end walls 117 and 118, are a first set of laterally extending door receiving rails or ledges 122–125 (see FIG. 9), with ledges 122 and 123 both at a predetermined distance from, and parallel to, the plane of the opening, the ledges 122–125 being formed of bar stock metal suitably welded to the interior surfaces of the walls 115–118. The upper edges of the ledges 122 through 125 define a plane which supports the doors 130, 131. The ledges 122–125 generally define the access opening 114.

The door arrangement includes first and second generally rectangular plate-shaped steel doors 130, 131, the overall dimension of the two doors, when placed side by side, in edge abutting relation, being of a dimension to substantially close the access opening 114 of the safe 110. By reference to FIGS. 9 and 13, the doors 130, 131 are shown in side elevation between end walls 117, 118, resting on the ledges 122–125, with door 130 being shorter than door 131, and, with the two doors placed in edge abutting relation, the overall dimension in the direction of the sliding of the doors is a predetermined dimension less than the dimension between end walls 117, 118.

The end walls 117 and 118 have first and second groove means formed between the corresponding ledge and an upper bar member, with the thickness of the groove being slightly greater than the thickness of the coacting edge of the plate material for the doors 130, 131. As shown in FIGS. 10, 11, 13, and 14, these opposing laterally extending first and second grooves 132 and 134, are aligned and in spaced relation to, the upper edges of the walls 117 and 118. The groove 132 is formed by an upper bar member 137 secured to the interior of the end wall 117, such as by welding, with bar member 137 in spaced relation to the ledge 125, the spacing forming a door edge receiving groove 132 of a width slightly greater than the thickness of the coacting edge of the door 130. Similarly, the opposing groove 134 is formed by another upper bar member 138 secured to the interior of the end wall 117, such as by welding, with bar member 138 in spaced relation to the ledge 124, the spacing forming a door edge receiving groove of a width slightly greater than the thickness of the coacting edge of the second door 131. As can be seen, the inwardly protruding dimension of bar member 137 is about twice that of the inwardly protruding dimension of bar member 138, thus resulting in groove 132 having an insertion depth (the distance from the innermost edge to the groove seat defined by the end wall) of about twice that of groove 134.

Figure 9:
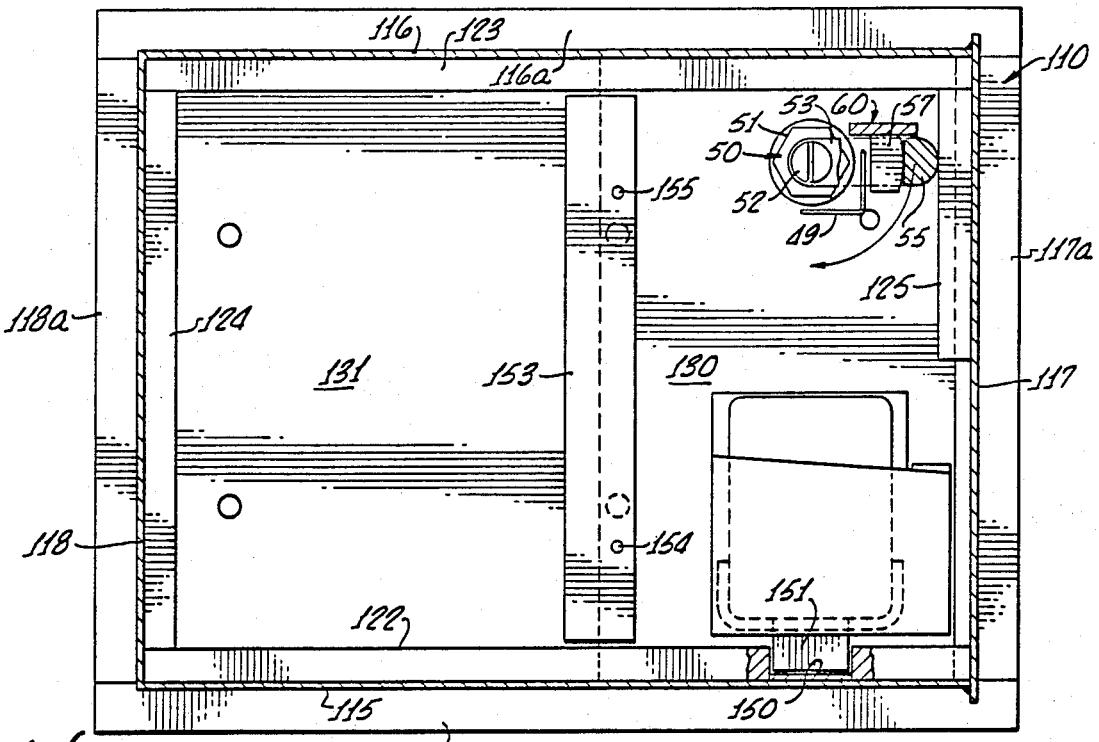
FIG. 9 is cross-sectional view, partially broken away, of the safe apparatus of FIG. 7 as viewed generally along line 9—9 thereof, to show details of the underside of the sliding double door arrangement with the door in the locked position and the locking mechanism in the locked position.
Figure 10:
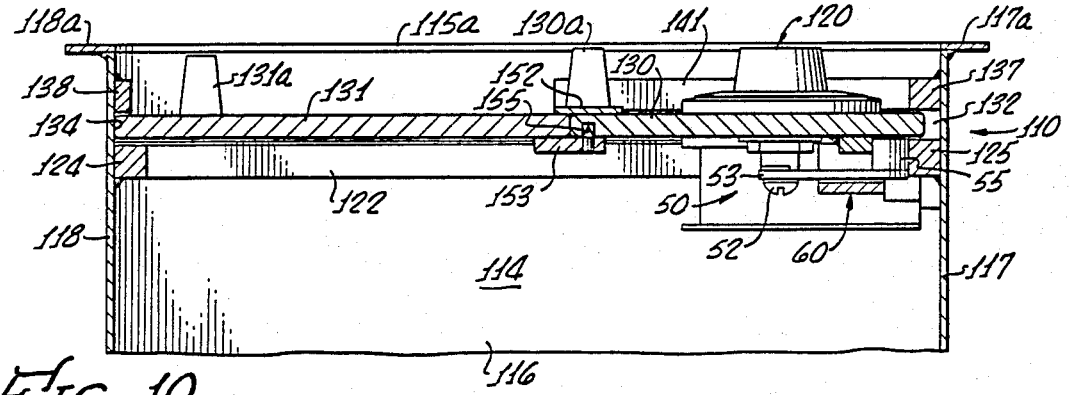
FIG. 10 is a side cross-sectional view of the door arrangement of the safe apparatus of FIG. 8, as viewed generally along line 10—10 thereof.
Figure 11:
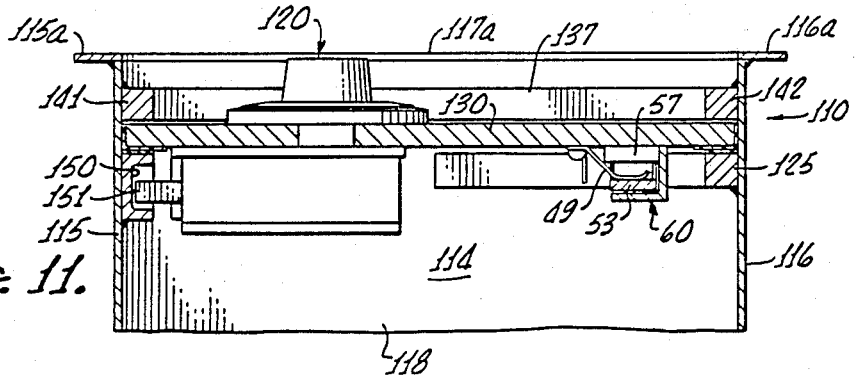
FIG. 11 is an end cross-sectional view of the door arrangement of the safe apparatus of FIG. 8, as viewed generally along line 11—11 thereof.

FIGS. 9 and 10 depict the doors 130, 131 in edge abutting relation slid to the left, as viewed therein, with the edge of door 131 bottomed within the seat of groove 134. As can be seen, there is a space or gap of a predetermined dimension between the rightmost edge of door 130 and the bottom of the groove 132, with this dimension being slightly greater than the dimension of the inward protrusion of bar member 138.

By referring to FIG. 8, above door 130, there is a second ledge, formed from lateral bar members 141 and 142, which are secured to the side walls 115 and 116, respectively. Bar members 141 and 142 form outer stop members for the side edges of door 130, along with the bar member 137. In addition, bar members 141 and 142, along with ledges 122 and 123 therebelow, define slide rails, for insertion of the door 130 therebetween. As shown in FIG. 10, with the doors 130 and 131 moved to the left (the locked position), the bar members 141, 142 have a dimension in the direction of sliding, which is longer than a dimension equal to the width of the door 130 in the same direction plus the predetermined dimension of the space to the right of the edge of door 130.

Figure 12:
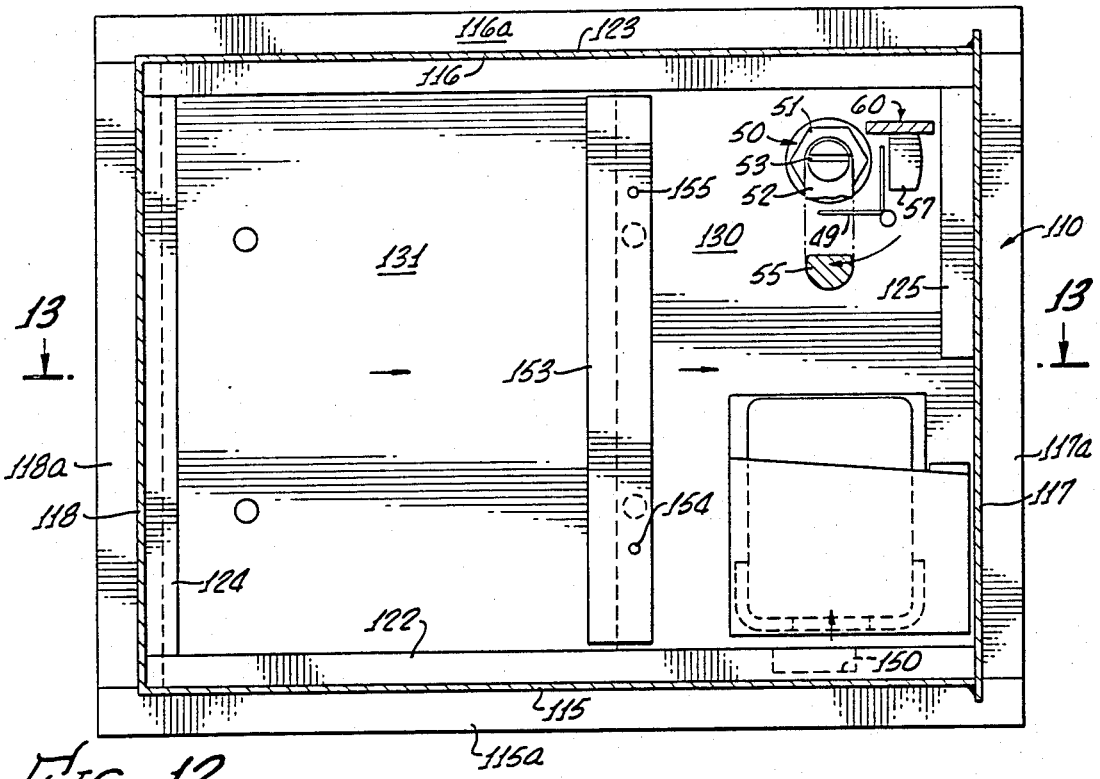
FIG. 12 is a bottom plan view of the door arrangement of the safe apparatus similar to the view of FIG. 9, with the locking mechanism unlocked, and the doors slid to a side in preparation for removal.

As shown in FIGS. 9 and 12, the bar 122 of the first ledge means is provided with an indention which forms a lock-bolt receiving notch 150 disposed in general alignment with the location of a lockbolt 151 of the lockset 120, which includes a combination dial accessible from the exterior of the door 130.

As shown in FIGS. 7 and 8, the door 130 includes a strap member 152 secured to the outer or upper surface thereof, to conceal the junction of the doors when in edge abutting relation as shown in FIG. 2. On the undersurface of door 131, there is a second strap secured thereto, which strap member 153 is secured thereto in overlapping relation to the edge at the junction. The second strap member 153 is provided with tapered alignment pins 154, 155, configured for mating coacting engagement with alignment holes, only one hole 157 being shown, which holes are formed in the inner or undersurface of the first door 130.

Referring now to FIGS. 9 through 14, the relationship of the door arrangement to the first set of ledges 122–125 and the second set of ledges 141, 142, as well as the grooves 132, 134, will be described. The combined area of the doors 130, 131 are dimensioned for having received in and completely removed from the access opening 112 of the chamber 114. The length of door member 130, that is, in the direction between end walls 117 and 118, is a dimension which is less than one-half the dimension between end walls 117 and 118. The width of the second member 131 is generally identical to the width of the first door member 130, with a length of a dimension less than the difference between the dimension between end walls and the dimension of the door 130 in the direction between end walls 117 and 118. This difference in combined length of the doors 130, 131 and the dimension between end walls 117, 118, is a predetermined dimension which is at least the inwardly extending dimension of the bar 138, which defines the upper part of groove 134.

Figure 13:
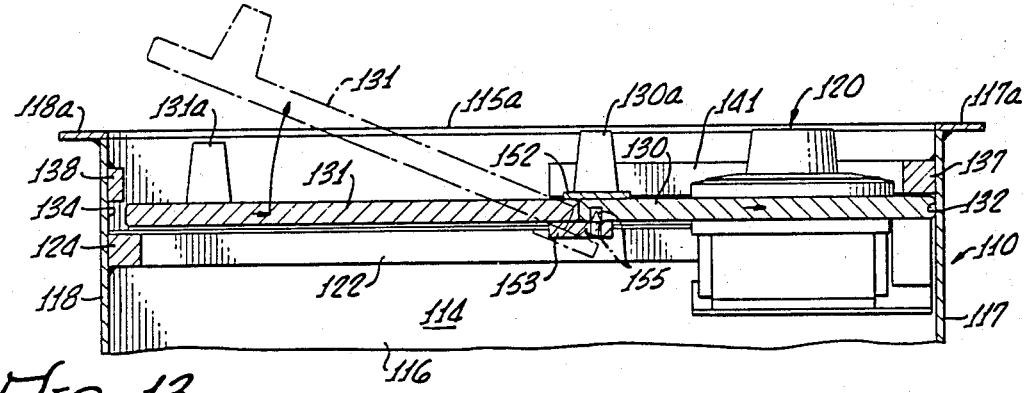
FIG. 13 is a side cross-sectional view showing the door arrangement in the position of FIG. 12, as viewed generally along line 13—13 thereof, with a broken line depiction of one door member positioned for removal or insertion.
Figure 14:
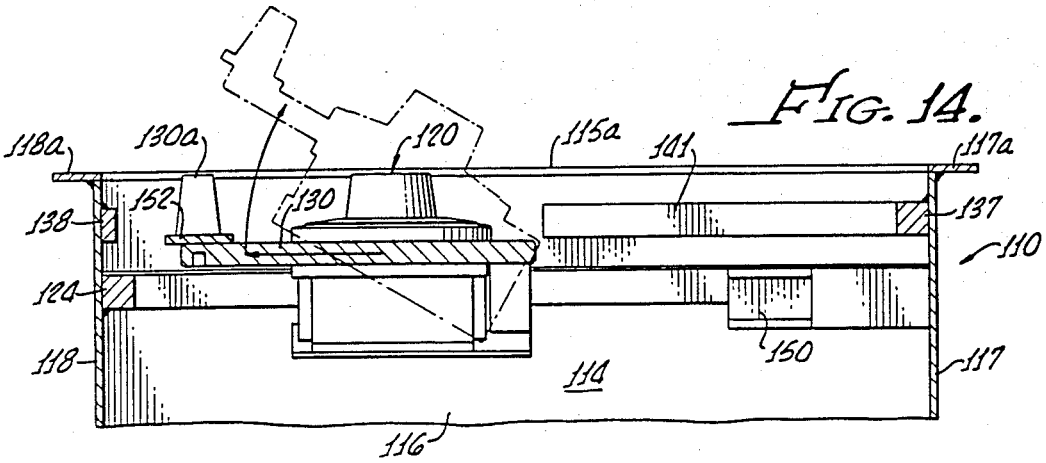
FIG. 14 is a side cross-sectional view similar to FIG. 12, with the other door member shown in solid lines and broken lines as positioned for removal or insertion.

By specific reference to FIGS. 10 and 13, FIG. 10 shows both doors 130, 131, in position on ledges 122–125, with the combined door arrangement slid to the left, as viewed in the drawings, to the locked position, that is, with lockbolt 151 in engagement within notch 150 of bar 123. At the right side thereof, there is a gap of predetermined dimension, the dimension of this gap being slightly more then the width of the bar 138 on the opposite upper side of the door arrangement. FIG. 13 shows, in solid lines, the doors 130 and 131 in edge abutting relation, slid to the right, as viewed in the drawings, in a position preparatory to insertion or removal of the doors 130, 131.

For insertion, the first 1door 30 is held by the handle 131*a* and is placed on ledges 122, 123, and slid to the right as viewed in FIG. 13, sliding in the slide rails formed between lower ledges 122–125 and upper ledge bars 141, 142. The second door 131 is inserted at an angle as shown in broken lines 131' in FIG. 13, with the door 131 having slightly rounded lower corners (not shown) at the point of contact with the ledges 122, 123.

As the door 131 is pivoted downwardly to the solid line position, with the coacting edges held in abutting relation, the pins 154, 155, pivot upwardly into the alignment holes 157. The door 131 is being lowered along the opposite edge until this opposite edge clears the upper edge of bar 138, forming the upper part of groove 134. Thereafter the door 131 is permitted to drop until totally supported by the longitudinally extending ledges formed by bar members 122, 123. The combined door arrangement of coupled doors 130, 131, is then shifted laterally in the opposite direction into the groove 134 until the edge of door member 131 is seated in the groove 134 in abutting relation with the side wall 118, as shown in FIG. 10. At this position, the lockbolt 151 is in alignment with the notch 150 and the combination of lock 120 may be spun to lock the doors 130 and 131 in position.

In accordance with this embodiment, a key locking assembly 50 is provided on door member 130. The locking assembly 50 is identical in structure and operation to that previously described. The locking assembly 50 is key actuable at the exterior of door 130, and is positioned opposite the combination lock mechanism 120.

FIGS. 9 and 10 depict the door 130 with the combinatin lock assembly 121 in its locked position, and FIG. 12 depicts the same view with the combination lock assembly 121 in its locked position, about ninety degrees from the unlocked position. FIGS. 9 and 10 also depict the door arrangement with the lock assembly 50 in its locked position, and FIG. 12 depicts the same view with the lock assembly 50 in its unlocked position, about ninety degrees from the locked position.

By reference to FIGS. 9 through 12, a short bar piece stop member 172 formed of steel is suitably secured to the undersurface of the door 130 at a position in alignment with the locking arm 52 in its locked position, the stop member 172 being located rearwardly of the position of the blocking member 55. The stop member 172 is positioned for coaction with a side of the blocking member 55, to assist in the deterrent effect in resisting lateral prying of the door arrangement 130, 131, when in place in edge abutting relation.

By reference to FIGS. 9 and 10, the diameter or width of the blocking member 55 in such that, when positioned on the arm 52, and with the arm 52 in the locked position, the blocking member extends into engagement with the bar 125 below the edge of the door 130, with the second door 131 bottomed in its groove 34. In this position, the blocking member 55 is in contact with the bar 125 on one side, and in contact with the stop member 172 on the other. As in the first embodiment, the anti-intrusion member 60, is also provided to thwart entry to the safe 110.

In accordance with the safe construction hereinabove described, there is a simple, yet effective safe construction, with one or two doors, which may be equally applicable to a basic steel safe preassembled at the factory, or a cast in place safe.

While there have been shown and described preferred embodiments, it is to be understood that various other adaptations and modifications may be made within the spirit and scope of the invention. For example, although the doors are depicted as being formed of a plate member of generally uniform thickness, it is only necessary that the groove contacting edges be of a thickness consistent for being received within the appropriate spaces or grooves. In addition, while the blocking member of the first embodiment is shown as abutting against the wall, the member may also abut against an inwardly protruding member of the type shown in the second embodiment. Furthermore, it is to be understood that the term rectangular, equally includes a square configuration. Other such variations will be readily apparent to those skilled in the art, and it is intended that the invention be limited only to the scope of the appended claims.

I claim:

1. In a door closure arrangement for a safe having a first pair of opposing walls and a second pair of opposing walls for defining a chamber having an opening for receiving valuables therein, the combination comprising:

separable door means configured to close said opening;

rail means formed in one pair of opposing walls, said rail means being positioned and configured for abutting relation with the periphery of said door means in the closed position;

first and second groove means formed in the other pair of opposing walls, said groove means being configured and dimensioned for receiving opposing edges of said door means therein with said first groove means having a depth greater than said second groove means, said door means having a dimension in the direction between said groove means slightly less than the dimension between the bottoms of said groove means for permitting sliding movement of said door means in a given direction between said other pair of opposing walls on said rail means between said groove means;

lock means on said door means;

stop means on the inner surface of said door means in proximate relation to the edge of said door means adjacent said first groove means; and other means operative on actuation of said lock means to the locked position for interposing blocking means in generally abutting engagement between said stop means on said door means and a portion of the interior of said chamber adjacent said first groove means with said door means slid to a positioned bottomed within said second groove means for substantially preventing sliding movement of said door means in said given direction.

2. The door closure arrangement of claim 1 wherein said other means includes a lock arm operated by said lock means and said blocking means is carried by said lock arm.

3. The door closure arrangement according to claim 1 wherein said door means includes one plate-shaped separable door member.

4. In a door closure arrangement for a safe having a first pair of opposing walls and a second pair of opposing walls for defining a chamber having an opening for receiving valuables therein, the combination comprising:

separable door means configured to close said opening;

rail means formed in one pair of opposing walls, said rail means being positioned and configured for abutting relation with the periphery of said door means in the closed position;

first and second groove means formed in the other pair of opposing walls, said groove means being configured and dimensioned for receiving opposing edges of said door means therein with said first groove means having a depth greater than said second groove means, said door means having a dimension in the direction between said groove means slightly less than the dimension between the bottoms of said groove means for permitting sliding movement of said door means on said rail means between said groove means;

lock means on said door means; and other means operative on actuation of said lock means to the locked position for interposing blocking means between said door means and a portion of the interior of said chamber adjacent said first groove means with said door means slid to a position bottomed within said second groove means for substantially preventing sliding movement of said door means; and wherein said door means includes first and second plate-shaped separable door members dimensioned for positioning on said rail means in edge abutting relation and said lock means are located on the one of said door members positioned adjacent said first groove means.

5. The door closure arrangement of claim 3 wherein said other means includes a lock arm operated by said lock means and said blocking means is carried by said lock arm.

6. The door closure arrangement of claim 4 wherein said other means includes a lock arm operated by said lock means and said blocking means is carried by said lock area.

7. In a door closure arrangement for a safe having opposing side walls and opposing end walls defining a chamber having an opening for receiving valuables therein, the combination comprising:

separable door means configured to close said opening;

rail means formed in opposing walls of at least one of said sidewalls and said end walls, said rail means being positioned and configured for abutting relation with the periphery of said door means in the closed position;

first and second groove means formed in opposing walls of the other of said at least one of said sidewalls and said end walls, said groove means being configured and dimensioned for receiving opposing edges of said door means therein with said first groove means having a depth greater than said second groove means, said door means having a dimension in the direction between said groove means slightly less than the dimension between the bottoms of said groove means for permitting sliding movement of door means in a given direction between said other pair of opposing walls on said rail means between said groove means;

stop means on the inner surface of said door means in proximate relation to the edge of said door means adjacent said first groove means;

lock means on said door means in proximate relation to said stop means, said lock means including an arm actuable between a first unlocked position and a second locked position; and blocking means on the distal end of said arm, which, with said arm in said second locked position interposes said blocking means, in generally abutting engagement, between said stop means and a portion of the interior of said chamber adjacent said first groove means with said door means slid to a position bottomed within said second groove means for substantially preventing sliding movement of said door means in said given direction.

8. The door closure arrangement according to claim 7 wherein said lock means is a key actuable lock having a rotatable barrel portion for pivoting said arm and said arrangement further includes means on the inner surface of said door means in proximate relation to, said barrel portion for deterring displacement of said barrel portion under force with a punch tool.

9. A closure and locking arrangement for a safe apparatus including wall means defining a generally rectangular chamber for receiving valuables therein through an access opening thereof, with ledge means on said wall means extending partially into said chamber, and first and second groove means on oppositely disposed ones of said wall means, said first groove means having a depth substantially greater than the depth of said second groove means, said arrangement comprising:

separate door means for closing said opening, said door means including at least a first and second opposing edge portions having a thickness sufficient for being received within said groove means and having a first dimension in the direction between said groove means generally equal to the distance between the innermost ends of said groove means plus a distance generally equal to the depth of said first groove means, and a second dimension orthogonal to said first dimension generally equal to the spacing between the wall means in that direction, said door means being configured for being received in abutting relation with said ledge means and slidable relative thereto through a distance generally equal to the depth of said first groove means;

lock means on said door means in proximate relation to an edge portion engaging said first groove means, said lock means being actuable between a first locked position and a second unlocked position;

stop means on the inner surface of said door means in proximate relation to the edge portion of said door means adjacent said first groove means;

blocking means; and means cooperatively interconnected to said lock means and said blocking means and responsive to actuation of said locking means, which, with said lock means in said first locked position interposes said blocking means, in generally abutting engagement, between said stop means and said wall means including said first groove means with said door means slid to a position bottomed within said second groove means for substantially preventing sliding movement of said door means.

10. The closure and locking arrangement according to claim 9 wherein said door means includes stop means on the inner surface thereof in a position for contacting said blocking means on the side thereof opposite the wall means including said first groove means.

11. The door closure arrangement according to claim 9 wherein said lock means is a key actuable lock having a rotatable barrel portion and said interconnecting means includes a lock arm pivotable by said barrel portion, and said arrangement further includes means on the inner surface of said door means in general alignment with, and in proximate relation to, said lock arm for deterring displacement of said barrel portion under force with a punch tool.

12. The door closure arrangement according to claim 11 wherein said door means includes one plate-shaped separable door member.

13. A locking arrangement for a safe apparatus including wall means defining a generally rectangular chamber for receiving valuables therein through an access opening thereof, with ledge means on said wall means extending partially into said chamber for receiving door means in abutting relation therewith, and first and second groove means of unequal depth on oppositely disposed ones of said wall means configured for receiving opposite edges of said door means, said door means being configured for being received in abutting relation with said ledge means and slidable relative thereto and relative to said groove means through a small distance generally equal to the depth of the shallower of said groove means, said arrangement comprising:

lock means on said door means in proximate relation to an edge portion engaging the deeper of said groove means, said lock means being actuable between a first locked position and a second unlocked position;

stop means on the inner surface of said door means in proximate relation to the edge of said door means adjacent said deeper groove means;

blocking means; and means cooperatively interconnected to said lock means and said blocking means and responsive to actuation of said locking means, which, with said lock means in said first locked position interposes said blocking means, in generally abutting engagement, between said stop means and said wall means including the deeper of said groove means with said door means slid to a position bottomed within the shallower of said groove means for substantially preventing sliding movement of said door means.

14. The locking arrangement according to claim 13 wherein said lock means is a key actuable lock having a rotatable barrel portion and said interconnecting means includes a lock arm pivotable by said barrel portion, and said arrangement further includes means on the inner surface of said door means in proximate relation to, said barrel portion for deterring displacement of said barrel portions under force with a punch tool.

15. In a safe apparatus, the combination comprising:

opposing side walls and opposing end walls defining a chamber having an opening for receiving valuables therein;

a separable door member configured to close said opening and having at least the first and second opposite edges thereof of generally uniform thickness;

rail means formed in opposing walls of at least one of said sidewalls and said end walls, said rail means being positioned and configured for abutting relation with the periphery of said door member in the closed position;

first and second opposing groove means formed in opposing walls of the other of said at least one of said sidewalls and said end walls, said groove means being of a width slightly greater than the thickness of said opposite edges of said door member, said first groove means having a depth greater than said second groove means and being dimensioned for enabling the insertion of said door means by positioning at an angle with said first edge thereof in engagement with said ledge means and then sliding said first edge into said first groove means while pivoting said second edge toward said rail means until said door means rests on said rail means, whereupon, by sliding said door means toward said second groove means a gap is formed intermediate said first edge and the wall including said first groove means;

a stop member formed on the inner surface of said door member in proximate relation to the edge of said door member adjacent said first groove means;

lock means on said door means in proximate relation to said stop means and including an arm actuable between a first unlocked position and a second locked position; and blocking means on the distal end of said arm for positioning, with said lock means in said second position, in generally abutting engagement between said stop means and the wall including said first groove means for substantially preventing sliding movement of said door means with said door means bottomed in said second groove means.

16. The door closure arrangement according to claim 15 wherein said lock means is a key actuable lock having a rotatable barrel portion and said interconnecting means includes a lock arm pivotable by said barrel portion, and said arrangement further includes means on the inner surface of said door means in proximate relation to said barrel portion for deterring displacement of said barrel portion under force with a punch tool.

17. A safe apparatus comprising:

a first pair of opposing wall means:

a second pair of opposing wall means interconnecting with the first pair of opposing wall means to define a valuables receiving chamber;

rail means within the chamber;

first and second grooves in one pair of opposing wall means, said grooves having depths of unequal dimensions;

separable door means having a first dimension slightly less than the dimension between the other pair of opposing wall means and a second dimension generally equal to the distance between bottoms of said grooves less a dimension generally equal to the depth of the shallower groove, said door means being configured for having opposing edges received within said first and second grooves and slidable relative to said rail means;

a stop member on the inner surface said door means;

a blocking member; and lock means actuable between locked and unlocked positions;

means operable in response to actuation of said lock means to said locked position for placing said blocking member intermediate said stop member and the wall of said wall means including the deeper groove for substantially preventing sliding movement of said door means with said door means bottomed in said shallower groove.

18. The safe apparatus according to claim 17 wherein said lock means in a key actuable lock having a rotatable barrel portion and said means operable in response to actuation thereof includes a lock arm pivotable by said barrel portion.

19. The safe apparatus according to claim 18 further including plate means secured in spaced relation to the inner surface of said door means in proximate relation to said lock arm for deterring displacement of said barrel portion under force with a punch tool.

20. A safe apparatus comprising:

a first pair of opposing wall means;

a second pair of opposing wall means interconnecting with the first pair of opposing wall means to define a valuables receiving chamber with an access opening;

rail means on one pair of opposing wall means within the chamber;

first and second grooves in the other pair of opposing wall means, said grooves having depths of unequal dimension;

first and second separable generally rectangular door means configured for edge abutting relation, each of said door means having a first dimension slightly less than the dimension between the one pair of opposing wall means, said first door means having a second dimension smaller than the second dimension of said second door means, said door means, when in edge abutting relation, having a combined second dimension generally equal to the distance between the bottoms of said grooves less a dimension generally equal to the depth of the shallower groove, said door means, when in edge abutting relation, being configured for having opposing edges received within said first and second grooves and slidable relative to said rail means;

ledge means on said one pair of wall means in spaced relation to said rail means for receiving said first door means in the space therebetween, said ledge means having an extent slightly greater than the second dimension of said first door means for providing an overhanging portion which, in conjunction with the shallower groove retains said second door means in said opening with said first door means in edge abutting relation therewith;

a stop member on the inner surface of said first door means;

a blocking member; and lock means actuable between locked and unlocked positions;

means operable in response to actuation of said lock means to said locked position for placing said blocking member intermediate said stop member and the wall of said wall means including the deeper groove for substantially preventing sliding movement of said door means with said second door means bottomed in said shallower groove.

21. The safe apparatus according to claim 20 wherein said lock means is a key actuable lock having a rotatable barrel portion and said means operable in response to actuation thereof includes a lock arm pivotable by said barrel portion.

22. The safe apparatus according to claim 21 further including plate means secured in spaced relation to the inner surface of said first door means in proximate relation to said lock arm for deterring displacement of said barrel portion under force with a punch tool.

23. A method for closing a safe having first and second pairs of opposing walls defining a generally rectangular chamber for receiving valuables therein through an access opening thereof, the method comprising:

providing first and second groove means of unequal depth on the opposite walls of said first pair of walls;

providing ledge means on opposing walls of said second pair of walls extending partially into said chamber in general alignment with said first and second groove means;

positioning door means on said ledge means for substantially closing said access opening by having opposing edges thereof at least partially received with said groove means, said door means having a dimension in the direction between said groove means generally equal to the distance between the seats of said first and second groove means less a predetermined dimension slightly greater than the depth of the shallower of said groove means;

sliding said door means into contact with the seat of the shallower of said groove means; and interposing a blocking means into contact with a portion of said door means and a portion of said wall including the deeper of said groove means for substantially preventing sliding movement of said door means with said second door means bottomed in the shallower groove means.

24. A closure and locking arrangement for a safe apparatus including wall means defining a generally rectangular chamber for receiving valuables therein through an access opening thereof, with ledge means on said wall means extending partially into said chamber, and first and second groove means on oppositely disposed ones of said wall means, said first groove means having a depth substantially greater than the depth of said second groove means, said arrangement comprising:

first and second plate-shaped separable door members dimensioned for positioning on said ledge means in edge abutting relation for closing said opening, said door members, when so positioned, including at least a first and second opposing edge portions having a thickness sufficient for being received within said groove means and having a first dimension in the direction between said groove means generally equal to the distance between the innermost ends of said groove means plus a distance generally equal to the depth of said first groove means, and a second dimension orthogonal to said first dimension generally equal to the spacing between the wall means in that direction, said door members being configured for being received in abutting relation with said ledge means and slidable relative thereto in a given direction through a distance generally equal to the depth of said first groove means;

a key actuable lock having a rotatable barrel portion, said lock being on one of said door members adjacent the edge engaging said first groove means and being actuable between a first locked position and a second unlocked position;

a lock arm pivotable by said barrel portion;

blocking means carried by said lock arm and responsive to actuation of said lock for positioning said blocking means into proximate relation with the wall means including said first groove means with said door means slid to a position bottomed within said second groove means for substantially preventing sliding movement of said door means toward said first groove means;

stop means on the inner surface of said one door member in a position for contacting said blocking means on the side thereof opposite the wall means including said first groove means; and means on the inner surface of said one door member in general alignment with, and in proximate relation to, said lock arm for deterring displacement of said barrel portion under force of a punch tool.

* * * * *